US009975333B2

(12) United States Patent
Takano et al.

(10) Patent No.: US 9,975,333 B2
(45) Date of Patent: May 22, 2018

(54) LIQUID DISCHARGING APPARATUS, CONTROL METHOD OF LIQUID DISCHARGING APPARATUS, AND DEVICE DRIVER

(71) Applicant: SEIKO EPSON CORPORATION, Tokyo (JP)

(72) Inventors: Koji Takano, Shiojiri (JP); Satoshi Shimizu, Kobe (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/450,955

(22) Filed: Mar. 6, 2017

(65) Prior Publication Data

US 2017/0259561 A1 Sep. 14, 2017

(30) Foreign Application Priority Data

Mar. 11, 2016 (JP) ..... 2016-047889

(51) Int. Cl.
*B41J 2/165* (2006.01)
*B41J 2/045* (2006.01)

(52) U.S. Cl.
CPC ..... *B41J 2/04541* (2013.01); *B41J 2/0451* (2013.01); *B41J 2/04551* (2013.01);
(Continued)

(58) Field of Classification Search
CPC .. B41J 2/04541; B41J 2/0451; B41J 2/04551; B41J 2/04586; B41J 2/165; B41J 2/16579; B41J 2002/16573
See application file for complete search history.

(56) References Cited

U.S. PATENT DOCUMENTS 7,300,131 B2 * 11/2007 Sakagami ..... B41J 2/0451 347/19
8,147,028 B2 * 4/2012 Ito ..... B41J 2/16579 347/19

(Continued)

FOREIGN PATENT DOCUMENTS

JP 2004-174832 A 6/2004
JP 2006-256109 A 9/2006

(Continued)

OTHER PUBLICATIONS

European Search Report issued in Application No. 17160010 dated Aug. 1, 2017.

*Primary Examiner* — Anh T. N. Vo
(74) *Attorney, Agent, or Firm* — Workman Nydegger

(57) ABSTRACT

A liquid discharging apparatus includes a liquid discharging head that discharges a liquid from a nozzle, a control circuit that controls a discharge operation of the liquid discharging head, a nozzle omission detection mechanism that detects a discharge fault of the nozzle, a maintenance mechanism that performs a maintenance operation, which ejects the liquid from the nozzle of the liquid discharging head, and a display device that displays a setting screen relating to the discharge operation of the liquid discharging head. The control circuit executes the discharge operation of the liquid discharging head on the basis of the operation mode selected by a user using the operation mode selection screen for selecting a plurality of operation modes in which a situation in which a transition to the maintenance operation is performed in a case in which the discharge fault is detected, differs, on the display device.

11 Claims, 8 Drawing Sheets

(52) U.S. Cl.
CPC ..... *B41J 2/04586* (2013.01); *B41J 2/165* (2013.01); *B41J 2/16579* (2013.01); *B41J 2002/16573* (2013.01)

(56) References Cited

U.S. PATENT DOCUMENTS

| | | | | |
|---|---|---|---|---|
| 8,322,814 | B2 * | 12/2012 | Hirato | B41J 2/0451 347/10 |
| 2015/0304509 | A1 | 10/2015 | Jintsugawa et al. | |

FOREIGN PATENT DOCUMENTS

| | | | |
|---|---|---|---|
| JP | 2010-058464 | A | 3/2010 |
| JP | 2011-167959 | A | 9/2011 |

* cited by examiner

FIG. 4

PRINTING SETTING SCREEN (1) PAPER SETTING (2) PG SETTING (3) OPERATION MODE SETTING ▶

FIG. 5

OPERATION MODE SELECTION SCREEN

| | |
|---|---|
| (1) CYAN | SAFE ▶ |
| (2) MAGENTA | SEMI-SAFE |
| (3) YELLOW | FORCED PRINTING |
| (4) BLACK | SAFE |

FIG. 6

INDIVIDUAL OPERATION MODE SELECTION SCREEN (CYAN)

(1) SAFE (2) SEMI-SAFE (3) FORCED PRINTING

FIG. 9

ALERT AND OPERATION SELECTION SCREEN

⚠ NOZZLE OMISSION HAS BEEN DETECTED.

BLACK NOZZLE: 3 LOCATIONS
ADJACENCY: YES

PLEASE SELECT PROCESS AFTER CHECKING PRINTING RESULT.

(1) CLEANING (2) CONTINUE PRINTING

LIQUID DISCHARGING APPARATUS, CONTROL METHOD OF LIQUID DISCHARGING APPARATUS, AND DEVICE DRIVER

BACKGROUND

1. Technical Field

The present invention relates to a liquid discharging apparatus such as an ink jet type recording apparatus, a control method of a liquid discharging apparatus, and a device driver, and in particular, relates to a liquid discharging apparatus, a control method of a liquid discharging apparatus, and a device driver that are capable of performing a maintenance operation that recovers liquid discharge faults in nozzles of a liquid discharging head.

2. Related Art

A liquid discharging apparatus is an apparatus that is provided with a liquid discharging head, and that discharges (ejects) various liquids from a nozzle of the liquid discharging head. Image recording apparatuses such as ink jet type printers and ink jet type plotters are examples of such liquid discharging apparatuses, but in recent years, liquid discharging apparatuses have also been applied to various manufacturing apparatuses to make use of the feature of being able to accurately land a very small quantity of liquid in a predetermined position. For example, liquid discharging apparatuses have been applied to display manufacturing apparatuses that manufacture color filters such as liquid crystal displays, electrode formation apparatuses that form electrodes such as organic Electro Luminescence (EL) displays and Field Emitting Displays (FEDs), and chip manufacturing apparatuses that manufacture biochips (biochemical elements). Further, liquid form ink is discharged in recording heads for image recording apparatuses, and solutions of each color material of Red (R), Green (G), and blue (B) are discharged from a nozzle in color material discharging heads for display manufacturing apparatuses. In addition, liquid form electrode materials are discharged in electrode material discharging heads for electrode formation apparatuses, and solutions of living organic material are discharged from a nozzle in living organic material discharging heads for chip manufacturing apparatuses.

In the above-mentioned liquid discharging apparatuses, in a case in which a discharge fault in which liquid is not discharged from a nozzle of the liquid discharging head, occurs, a technique that restores the discharge performance of liquid in a nozzle by executing a maintenance operation (a suction cleaning operation) that ejects liquid and air bubbles from a nozzle as a result of changing the inside of a sealed space portion to have a negative pressure using a suction unit in a state in which a nozzle surface of the liquid discharging head is sealed using a capping member, is adopted (for example, refer to JP-A-2010-058464). In addition, in recent years, liquid discharging apparatuses that execute a maintenance operation (a pressurization cleaning operation) that ejects ink and air bubbles from a nozzle in a cap, or the like, by increasing the pressure of an upstream side in a supply pathway of liquid more than the liquid discharging head using a pressurization unit (a flow channel pump), have been proposed (for example, refer to JP-A-2011-167959).

However, in a case in which a discharge fault occurs in a nozzle, depending on the type of liquid to be discharged or the type of landing target of the corresponding liquid, there are also cases in which there is not a problem with the quality of a product (for example, an image, or the like, that is formed as a result of a liquid landing on a landing target such as a recording medium) of a discharge operation even if a maintenance operation is not performed. Additionally, there are also cases in which, as long as the quality of the product is satisfactory, a user prefers not to have a deterioration in throughput due to the operation time as a result of the maintenance operation being executed, or the consumption of liquid in the maintenance operation. However, in a case in which a discharge operation is continued without performing the maintenance operation in a state in which a discharge fault has occurred, in a configuration that calculates a residual amount of liquid in a liquid retention member on the basis of the number of discharge operations by a driving element (the number of applications of a driving pulse to the driving element), as a result of liquid being counted as consumed liquid regardless of the fact that liquid is not discharged from a nozzle in practice, there are also cases in which there is an inconsistency between a corresponding count value and a practical consumption amount of liquid. In this case, there are cases in which, regardless of the fact that there is liquid remaining in the liquid retention member, it is determined that the residual amount of liquid is depleted on the basis of the count value, and therefore, it is not possible to continue the discharge operation. In addition, in a configuration in which a user is prompted in a case in which it is determined that the residual amount of liquid is depleted on the basis of the count value, it is possible to consider being prompted as inconvenient to the user.

SUMMARY

An advantage of some aspects of the invention is to provide a liquid discharging apparatus, a control method of a liquid discharging apparatus, and a device driver that are capable of performing a discharge operation and a maintenance operation that correspond more closely to the needs of a user.

According to an aspect of the invention, there is provided a liquid discharging apparatus including a liquid discharging head that discharges a liquid from a nozzle, a control circuit that controls a discharge operation of the liquid discharging head, a nozzle omission detection mechanism that detects a discharge fault of the nozzle, a maintenance mechanism that performs a maintenance operation, which ejects the liquid from the nozzle of the liquid discharging head, and a display device that displays a setting screen relating to the discharge operation of the liquid discharging head, in which the control circuit displays an operation mode selection screen for selecting a plurality of operation modes in which a situation in which a transition to the maintenance operation is performed in a case in which the discharge fault is detected, differs, on the display device, and executes the discharge operation of the liquid discharging head on the basis of the operation mode selected by a user using the operation mode selection screen.

According to the invention, it is possible to perform a discharge operation and a maintenance operation that are better adapted to the needs of a user.

In the above-mentioned configuration, it is preferable to adopt a configuration in which the plurality of modes are a first operation mode that transitions to the maintenance operation automatically in a case in which the discharge fault is detected, a second operation mode that executes either the discharge operation or the maintenance operation according to a selection of a user in a case in which the discharge fault is detected, and a third operation mode that executes the discharge operation without transitioning to the maintenance operation until a maintenance transition condition, which is established in advance, is satisfied.

According to this configuration, in the first operation mode, since a transition to the maintenance operation is performed in a case in which the discharge fault occurs, a deterioration, which is caused by the discharge fault, in the quality of a product such as an image that is formed on a landing target of the liquid by the discharge operation, is suppressed, and in addition, the inconvenience for a user of performing confirmation and selection relating to transitioning to the maintenance operation is also reduced. In the second operation mode, since it is possible for a user to select either a discharge operation or a maintenance operation in a case in which the discharge fault is detected, it is possible to more flexibly handle the demands of a user. Furthermore, in the third operation mode, since the discharge operation is executed without transitioning to the maintenance operation until a maintenance transition condition, which is established in advance, is satisfied, a deterioration in throughput as a result of a maintenance operation being executed, and waste of liquid due to the maintenance operation, are reduced, and in addition, the inconvenience for a user of performing confirmation and selection relating to transitioning to the maintenance operation is also reduced. In particular, it is possible to perform a discharge operation and a maintenance operation that are more optimized for types of liquid landing targets, and the like, in which it is unlikely that a problem will occur in the quality of a product due to a discharge operation even if the discharge operation is performed in a state in which the discharge fault occurs.

In addition, in the above-mentioned configuration, it is preferable to adopt a configuration in which, in a case in which the discharge fault is detected in the second operation mode, the control circuit displays an operation selection screen in which at least two of a first option that indicates continuing the discharge operation, a second option that indicates transitioning to the maintenance operation, and a third option that indicates changing the operation mode, are set as options, on the display device, transitions to an operation option reception mode that receives one of the options from a user via the corresponding operation selection screen, and executes a subsequent operation on the basis of a received option.

According to the above-mentioned configuration, it is possible to perform an operation that is desired by a user depending on the type of liquid to be discharged, the type of the landing target of the corresponding liquid, the content of a product of a discharge operation (including the content of an object that is expected to be obtained as a product), or the like.

In addition, in the above-mentioned configuration, it is preferable to adopt a configuration in which, in a case in which the discharge fault is detected in the second operation mode, the control circuit presents a user with information relating to the discharge fault of the nozzle using the display device or another presentation unit.

According to the above-mentioned configuration, the determination of operation selection by a user is facilitated as a result of presenting information relating to the discharge fault of a nozzle.

Furthermore, in the above-mentioned configuration, it is preferable to adopt a configuration in which, in a case in which the discharge fault is detected in the second operation mode, the control circuit does not transition to the operation option reception mode when a nozzle in which the current discharge fault is detected is the same as a nozzle in which the discharge fault was previously detected.

According to the above-mentioned configuration, it is possible to reduce the inconvenience for a user of performing the selection of an operation as a result of the discharge operation being interrupted for the operation option reception mode, and in addition, it is possible to suppress a deterioration in throughput.

In addition, in the above-mentioned configuration, it is preferable to adopt a configuration in which, in a case of not transitioning to the operation option reception mode, the control circuit transitions to the maintenance operation when an elapsed time since the discharge fault was detected exceeds a threshold value, which is established in advance, for the nozzle in which the discharge fault was previously detected.

According to the above-mentioned configuration, it is possible to execute a cleaning operation at a suitable timing. As a result of this, it is possible to suppress waste of liquid and operation time while reducing the risk that discharge performance will become irreparable.

In addition, in the above-mentioned configuration, it is preferable to adopt a configuration in which the maintenance transition condition in the third operation mode is a degree of occurrence of the discharge fault of a nozzle reaching a threshold value, which is established in advance.

According to the above-mentioned configuration, it is possible to reduce the risk that the quality of a product such as an image formed on a landing target of the liquid by the discharge operation will be significantly decreased, that the liquid discharge performance of the nozzle will become irreparable due to thickening, or the like.

In addition, in the above-mentioned configuration, it is preferable to adopt a configuration in which it is possible to select any one of a first discharge mode in which at least speed of the corresponding discharge operation is emphasized, and a second discharge mode in which quality of a product of the discharge operation on a landing target of the liquid is emphasized, as the discharge operation, and in which, in a case in which the second discharge mode is selected, the control circuit presents a user with a warning that prompts confirmation of the operation mode, using the display device or another presentation unit when the third operation mode is selected.

According to the above-mentioned configuration, in a case in which the second discharge mode is selected, as a result of prompting a user to check when the third operation mode is selected, a circumstance in which the quality of a product is impaired such as a case in which the third operation mode is set by mistake, can be prevented from occurring.

In addition, in the above-mentioned configuration, it is preferable to adopt a configuration in which the liquid discharging head is capable of discharging different types of liquid, and in which it is possible to set the operation mode for each type of liquid on the operation mode selection screen.

According to the above-mentioned configuration, it is possible to perform an operation that a user desires depending on the type of the liquid.

Furthermore, in the above-mentioned configuration, it is preferable to adopt a configuration in which the control circuit indicates an operation mode that corresponds to a type of a landing target of the liquid on the operation mode selection screen, as an initial setting.

According to the above-mentioned configuration, since an operation mode that corresponds to the type of landing target of the liquid is indicated as an initial setting, a circumstance in which a user is unsure of a selection is reduced.

Furthermore, according to another aspect of the invention, there is provided a control method of a liquid discharging apparatus provided with a liquid discharging head that discharges a liquid from a nozzle, a control circuit that controls a discharge operation of the liquid discharging head, a nozzle omission detection mechanism that detects a discharge fault of the nozzle, and a maintenance mechanism that performs a maintenance operation, which ejects the liquid from the nozzle of the liquid discharging head, the method including displaying an operation mode selection screen for selecting a plurality of operation modes in which a situation in which a transition to the maintenance operation is performed in a case in which the discharge fault is detected, differs, on a display device, receiving a selection of an operation mode by a user using the operation mode selection screen, and setting a received operation mode.

In addition, according to still another aspect of the invention, there is provided a device driver that can be executed in an information processing apparatus connected to a liquid discharging apparatus in a manner in which communication can be performed, in which the device driver executes the above-mentioned control method of a liquid discharging apparatus.

BRIEF DESCRIPTION OF THE DRAWINGS

The invention will be described with reference to the accompanying drawings, wherein like numbers reference like elements.

FIG. 4 is a view that shows an example of a printing setting screen.

FIG. 5 is a view that shows an example of an operation mode selection screen.

FIG. 6 is a view that shows an example of an individual operation mode selection screen.

FIG. 9 is a view that shows an example of an alert and an operation selection screen.

DESCRIPTION OF EXEMPLARY EMBODIMENTS

Hereinafter, aspects for implementing the invention will be described with reference to the appended drawings. Additionally, since the embodiments that are mentioned below are preferred specific examples of the invention, various limitations have been applied thereto, but the scope of the invention is not limited to these aspects unless a feature that specifically limits the invention is disclosed in the following description. In addition, in the following explanation, description is given using an ink jet type recording apparatus (hereinafter, referred to as a printer) as an example of the liquid discharging apparatus of the invention.

Figure 1:
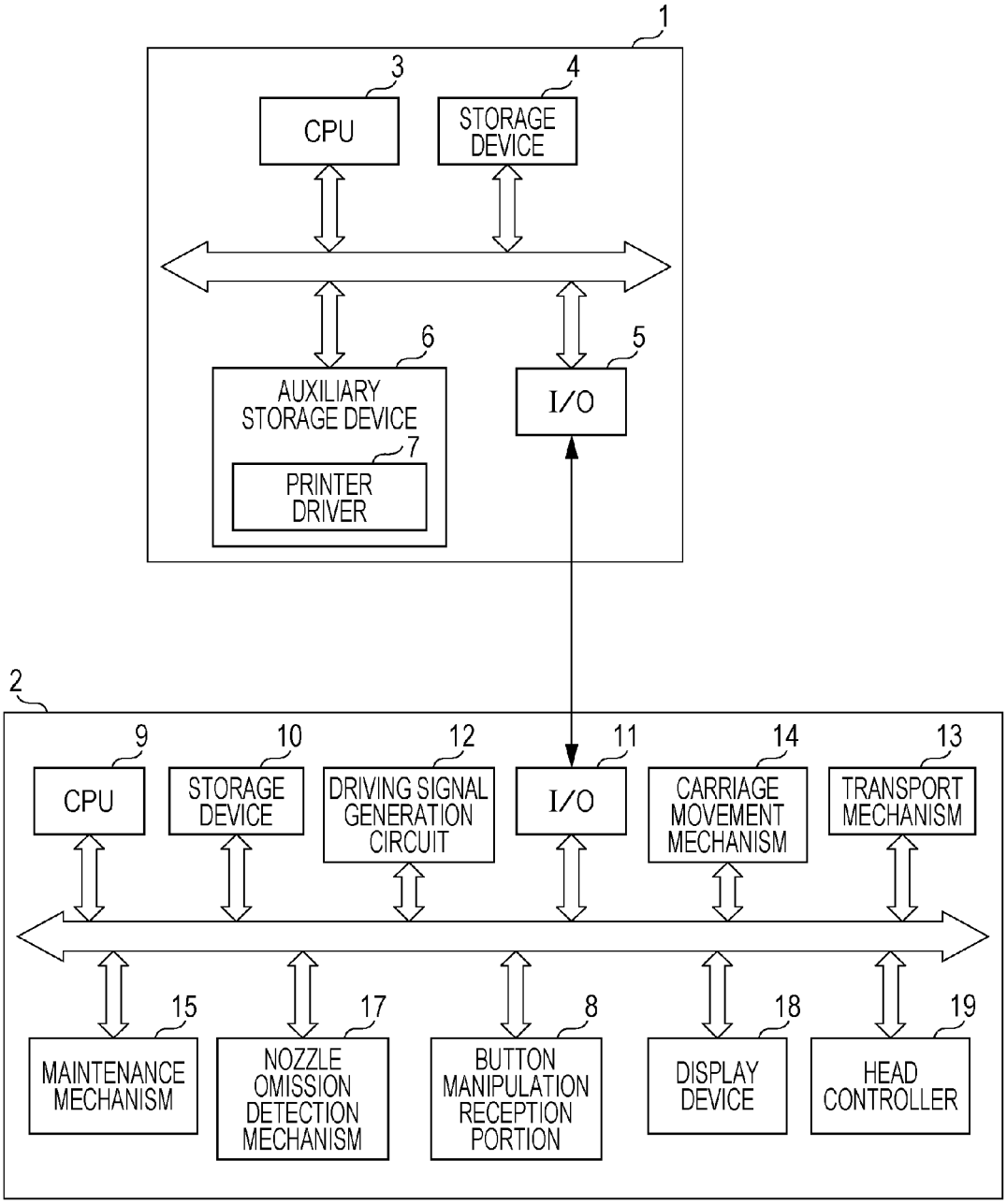
FIG. 1 is a block diagram that describes a configuration of a printing system.

FIG. 1 is a block diagram that describes a printing system that includes a printer according to the invention. The printing system is configuration by a computer 1, which is a type of information processing apparatus, and a printer 2, which is a type of liquid discharging apparatus, and the like, being connected in a manner in which communication can be performed in a wired or wireless manner. The computer 1 is provided with a CPU 3, a storage device 4, an input-output interface (I/O) 5, an auxiliary storage device 6, and the like, and these components are mutually connected by an internal bus. For example, the auxiliary storage device 6 is configured from a hard disk drive, and an operation program, various application programs, a printer driver 7 (a type of device driver of the invention), and the like, are stored in the auxiliary storage device 6. Further, the CPU 3 performs various processes such as the execution of the application programs and the printer driver 7 in accordance with an operating system stored in the auxiliary storage device 6. The input-output interface 5 is connected to an input-output interface (I/O) 11 of the printer 2, and outputs requests of a printing operation (a discharge operation) that the printer driver 7 creates, printing data, printing settings information, and the like related to printing to the printer 2. The printer driver 7 is a program that orders the printer 2 to execute a printing operation based on printing data, performs various printing settings of the printer 2, and the like.

The printer 2 in the present embodiment includes a CPU 9 (a type of control circuit of the invention), a storage device 10, the input-output interface 11, a driving signal generation circuit 12, a transport mechanism 13, a carriage movement mechanism 14, a maintenance mechanism 15, a nozzle omission detection mechanism 17, a button manipulation reception portion 8, a display device 18, a head controller 19, and the like. The input-output interface 11 performs the communication of various data such as receiving requests such as printing operations, printing settings information, and printing data from the computer 1 side, and outputting status information of the printer 2 to the computer 1 side. The CPU 9 is an arithmetic processing device for performing overall control of the printer, and controls a printing operation (a discharge operation of liquid) of a recording head 21. In addition, the CPU 9 creates dot pattern data (raster data) by receiving printing data from the computer 1 side, and transmits the corresponding dot pattern data to the head controller 19 of the recording head 21. The storage device 10 is an element that stores a program of the CPU 9 and the data used in various controls, and includes ROM, RAM, and NVRAM (nonvolatile storage element). The driving signal generation circuit 12 (a driving pulse generation circuit) generates a driving signal for driving a piezoelectric element 36 (FIG. 3) of the recording head 21 on the basis of waveform data relating to a waveform of the driving signal.

In addition, the CPU 9 also functions as a liquid consumption amount calculation unit (a discharge counter) and calculates an ink consumption amount (a liquid consumption amount) of an ink cartridge 22 (to be mentioned later) of each color in accordance with the discharge of ink droplets by the recording head 21. That is, the CPU 9 calculates an ink consumption amount for each color of ink by counting a number of discharges (a number of repetitions of the supply of a driving pulse to the piezoelectric element 36) of ink droplets for each ink cartridge 22, and multiplying a designed ink amount (weight) to be discharged by a single discharge operation by the discharge count value. The calculated ink consumption amount is stored in the storage device 10. Further, in a case in which the ink consumption amount exceeds a threshold value, which is established in advance, that is, in a case in which a residual amount of ink (a residual amount of liquid) inside an ink cartridge 22 is running low, for example, the CPU 9 notifies a user of the fact that the residual amount of ink inside the ink cartridge 22 is running low using the display device 18. In addition, information of the ink consumption amounts calculated by the CPU 9 is also output to the computer 1 via the input-output interface 11. In the computer 1, for example, display relating to the residual amount of ink inside each ink cartridge 22 is performed by the printer driver 7 on the basis of the ink consumption amounts from the printer 2 side. As a result of this, it is possible for a user to easily ascertain the replacement timing of the ink cartridges 22.

Figure 2:
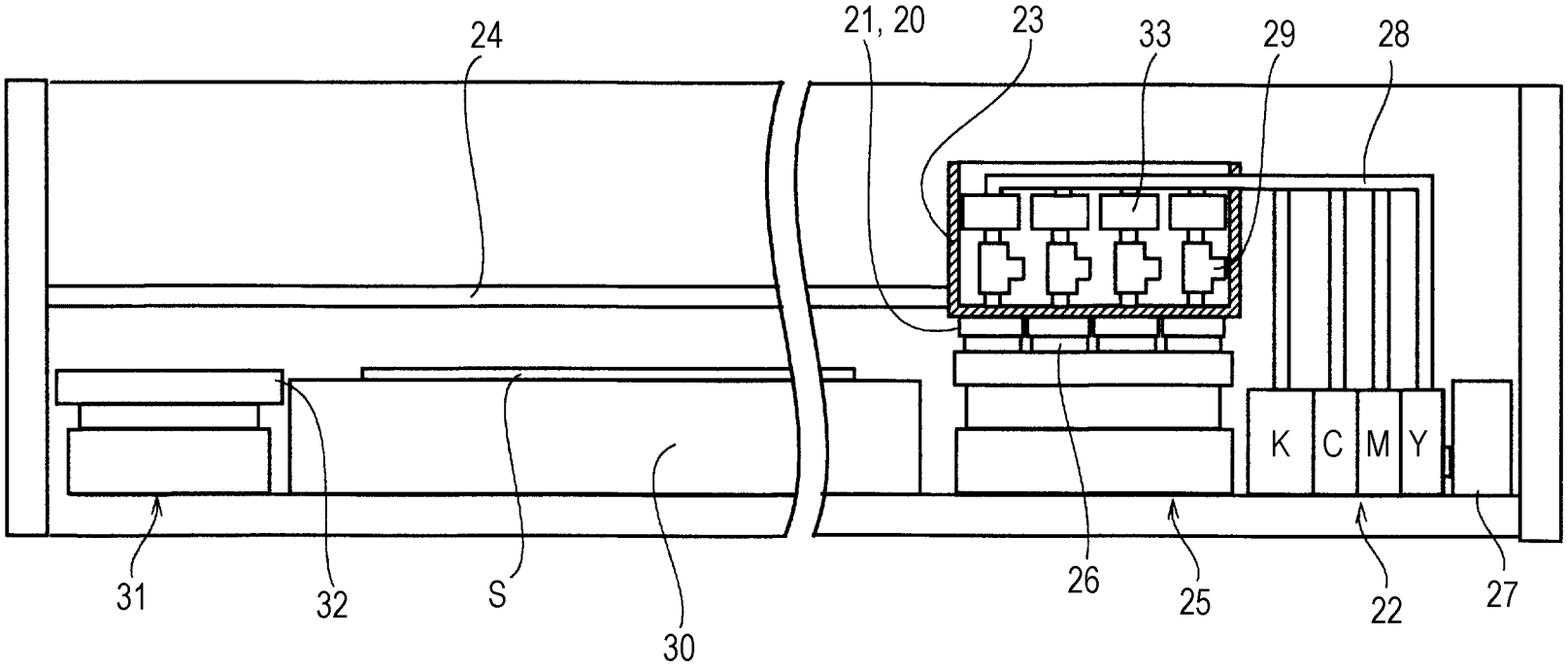
FIG. 2 is a front view that describes a configuration of a liquid discharging apparatus (a printer).

The carriage movement mechanism 14 is a mechanism for moving the recording head 21, which is mounted in a carriage 23 (FIG. 2). The transport mechanism 13 is a mechanism that transports a recording medium S such as a recording sheet on a platen 30. The maintenance mechanism 15 is provided with a flow channel pump 29, which will be mentioned later, a capping mechanism 25, and the like, and restores the discharge performance of ink of the recording head 21. The nozzle omission detection mechanism 17 is a mechanism that detects nozzle omission (a discharge fault), which is a state in which ink is not being discharged normally from a nozzle 38 (refer to FIG. 3, and the like) of the recording head 21. Additionally, the details of nozzle omission detection by the nozzle omission detection mechanism 17 will be mentioned later.

The head controller 19 performs control that selectively applies a driving pulse within a driving signal generated by the driving signal generation circuit 12, to the piezoelectric elements 36 of the recording head 21 on the basis of dot pattern data. The button manipulation reception portion 8 electrically detects manipulation of various manipulation buttons provided on a housing surface of the printer 2, and outputs a detection signal to the CPU 9. Accordingly, the CPU 9 can recognize which button is manipulated on the basis of the detection signal from the button manipulation reception portion 8. Further, a user can perform setting of sheets of paper, setting of various modes, and the like by manipulating the button manipulation reception portion 8 on a setting and selection screen such as the printing setting screen, which will be mentioned later. For example, the display device 18 is composed of a liquid crystal display device provided in the housing of the printer 2, and displays a printing setting screen (to be mentioned later) according to the control of the CPU 9. Additionally, a connection technique of the printer 2 and the computer 1 is not limited to that illustrated by way of example, and various methods can be adopted.

FIG. 2 is a front view that describes an internal configuration of the printer 2 in the present embodiment. In the printer 2, the recording head 21, which is a type of liquid discharging head, is attached to a guide rod 24 in a manner in which it is possible to reciprocate in a main scanning direction (the left-right direction in FIG. 2) as a result of being mounted on the carriage 23. The printer 2 prints and records characters, images, and the like (a type of product of a discharge operation) by discharging ink from the nozzle 38 (refer to FIG. 3) of the recording head 21 (head units 20) thereby causing the ink to land on the recording medium S, such as a recording sheet, a fabric, or a resin sheet, while sequentially transporting the recording medium S (a landing target of a liquid) on the platen 30 (a support platform) using the transport mechanism 13, and relatively moving the recording head 21 in the main scanning direction using the carriage movement mechanism 14. Additionally, in a case of performing printing on a fabric (a type of landing target of liquid) such as a woven fabric, a knitted fabric, or a non-woven fabric, printing is performed in a state of being set in a dedicated tray.

The ink cartridges 22 (a type of liquid retention member), in which each color of ink is retained, are installed in a removable manner on one side (the right side in FIG. 2) in the inner portion of the printer 2. In the present embodiment, ink cartridges 22 of a total of four colors (for example, cyan (C), magenta (M), yellow (Y), and black (K)) are respectively installed. The ink cartridges 22 are connected to a pressurization mechanism 27 composed of an air pump, and the like, and air from the pressurization mechanism 27 is supplied to the inside of each ink cartridge 22. Further, as a result of the pressure of ink packs, which are installed inside the ink cartridges 22 and are not illustrated in the drawings, being increased by the pressurized air, ink inside the ink packs is supplied to the recording head 21 (the head units 20) side through ink supply tubes 28. After the supply pressure is adjusted in pressure adjustment mechanisms 33, which are mounted in the carriage 23, the ink that is delivered from the ink cartridges 22 via the ink supply tubes 28 is supplied to ink flow channels of the inner portions of each head unit 20 in the recording head 21. In addition, flow channel pumps 29 (a type of maintenance mechanism of the invention) are provided in flow channels between the pressure adjustment mechanisms 33 and the head units 20. The flow channel pump 29 includes a diaphragm portion, which partitions a portion of the flow channel and which is not illustrated in the drawings, and can increase the pressure or decrease the pressure of ink inside the flow channel that is partitioned by the corresponding diaphragm portion. The flow channel pump 29 of the present embodiment is configured to be able to perform a cleaning operation (a pressurization cleaning operation) during printing, which is a type of maintenance operation, which will be mentioned later. That is, the flow channel pump 29 increases the pressure inside the flow channel, and restores the discharge performance of a nozzle 38 by removing blockages of the flow channel or the nozzle 38 due to thickened ink, air bubbles, or the like in the flow channel using the pressure. In the mid-printing cleaning operation, since it is also possible to restore the discharge performance of a nozzle 38 using predetermined of an extent at which ink is not ejected from the nozzle 38, it is possible to suppress an influence on the image quality of a recorded image, or the like.

The recording head 21 in the present embodiment is provided with a total of four head units 20 aligned in a horizontal manner in the main scanning direction to correspond to each ink cartridge 22. Each head unit 20 in the present embodiment is configured so as to discharge ink of a respectively different color. The configuration of each head unit 20 will be mentioned later. A home position, which is a standby position of the recording head 21, is set to a position that is shifted to one side in the inner portion of the printer 2 with respect to the platen 30. A capping mechanism 25 (a type of maintenance mechanism of the invention) is provided in the home position. In addition, a flushing box 31 is provided as a flushing region in the other end portion (the left side in FIG. 1) with the platen 30 interposed between the flushing box 31 and the home position. For example, the capping mechanism 25 includes caps 26 composed of elastic members such as a rubber or an elastomer, and is configured to be capable of converting between a sealed state (a capping state) in which the corresponding caps 26 abut against nozzle surfaces (nozzle plates 34) of the head units 20, and a retreat state in which the caps 26 are separated from the corresponding nozzle surfaces. The caps 26 are formed in a tray form in which surfaces that abuts against nozzle formation surfaces of the head units 20 are open, and a total of four caps 26 are provided to correspond to each head unit 20. Further, the nozzle formation surfaces of the recording head 21 are set to be in a capped state during standby such as when the power source of the printer 2 is turned off, and as a result of this, the evaporation of ink solvent from the nozzles 38 is suppressed.

In addition, in the maintenance operation (the suction cleaning operation), the capping mechanism 25 forcibly ejects ink and air bubbles into the inside of the caps 26 from the nozzles 38 of the head units 20 by changing interior spaces of the caps 26 to have a negative pressure as a result of operating a pump, which is not illustrated in the drawings, in the above-mentioned capped state. Waste ink that is ejected into the caps 26 is ejected to a waste ink tank, which is not illustrated in the drawings. In the present embodiment, a configuration in which it is possible to perform the corresponding cleaning operation for each head unit 20 is used.

The flushing box 31 includes a tray form ink reception portion 32 that receives ink discharged during a flushing operation, which forcibly discharges ink from a nozzle of the recording head 21 separately from a printing operation (a discharge operation) with respect to the recording medium S. One end of a liquid ejection tube, which is not illustrated in the drawings, is connected to the ink reception portion 32 and is in communication with a liquid ejection tank. In addition, a suction pump is provided midway through the liquid ejection tube, and ink inside the ink reception portion 32 is ejected to the liquid ejection tank through the liquid ejection tube as a result of operating the suction pump.

Figure 3:
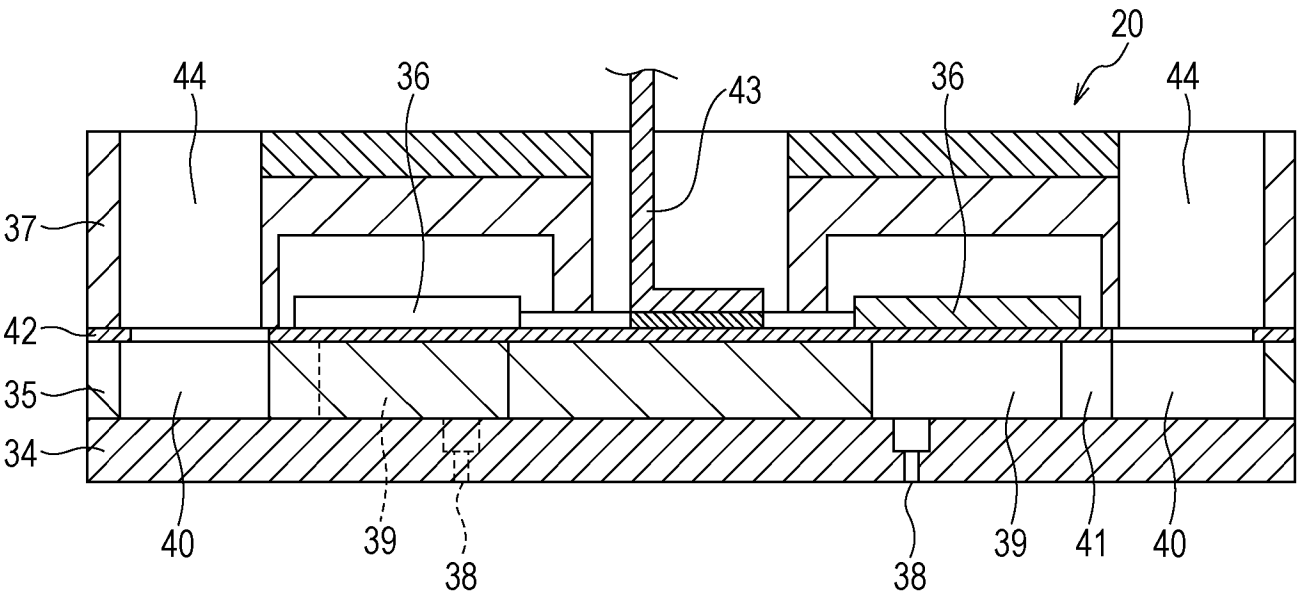
FIG. 3 is a cross-sectional view that describes a configuration of a liquid discharging head (a recording head).

FIG. 3 is a cross-sectional view that describes a configuration of the above-mentioned head units 20. Additionally, each head unit 20 provided in the recording head 21 has the same configuration. Each head unit 20 in the present embodiment has a schematic configuration including a nozzle plate 34, a flow channel substrate 35, the piezoelectric element 36, and the like, and is attached to a holder 37 in a state in which these members are stacked together. The nozzle plate 34 is a member composed of a monocrystalline silicon substrate in which a plurality of the nozzles 38 are provided in an open manner at a predetermined pitch in row form along a direction that corresponds to a sub-scanning direction. In the present embodiment, nozzle rows are conditions from a plurality of the nozzles 38 arrange in parallel. Two nozzle rows are formed in the nozzle plate 34 of the present embodiment, and ink of the same type (color) is allocated to these nozzle rows. Accordingly, a total of eight nozzle rows, two of each color of ink, are provided in the recording head 21 of the present embodiment. Additionally, a surface of the nozzle plate 34 on a side on which ink is discharged is equivalent to a nozzle surface of the head unit 20.

In the flow channel substrate 35, a plurality of space portions, which correspond to pressure chambers 39, are formed to correspond to each nozzle 38. A common liquid chamber 40 (a reservoir), which is a space portion that is common to each pressure chamber 39, is formed on the outer side of a row of the pressure chambers 39 in the flow channel substrate 35. The common liquid chamber 40 is in communication with each pressure chamber 39 through ink supply ports 41. In addition, ink from the ink cartridge 22 side is introduced to the common liquid chamber 40 through an ink introduction channel 44 of the holder 37. The piezoelectric elements 36 (a type of driving element of the invention) are formed on the upper surface of a side of the flow channel substrate 35 that is opposite to the nozzle plate 34 side via an elastic film 42. The piezoelectric elements 36 are formed by sequentially stacking a lower electrode film made from a metal, a piezoelectric body layer composed of lead zirconate titanate, or the like, for example, and an upper electrode film composed of a metal (none of which are illustrated in the drawings). The piezoelectric elements 36 are so-called flexural mode piezoelectric elements, and are formed so as to cover the upper portions of the pressure chambers 39. The piezoelectric elements 36 become deformed as a result of a driving signal (a driving pulse) from the driving signal generation circuit 12 being applied thereto through a wiring member 43. As a result of this, pressure vibrations occur in the ink inside the pressure chambers 39, which correspond to the corresponding piezoelectric elements 36, and ink is discharged from the nozzles 38 as a result of controlling the pressure vibrations.

In the printer 2 in the present embodiment, it is possible to select a plurality of operation modes in which the situation in which a transition to the maintenance operation of the maintenance mechanism 15 (either the flow channel pump 29 or the capping mechanism 25) is performed in a case in which nozzle omission (a discharge fault state in which ink is not discharged from a nozzle 38) is detected by the nozzle omission detection mechanism 17 in printing, differs. More specifically, the printer 2 is configured so that it is possible to select three modes of a first operation mode (hereinafter, a safe mode) that transitions to the maintenance operation automatically in a case in which a discharge fault is detected, a second operation mode (hereinafter, a semi safe mode) that executes either the discharge operation or the maintenance operation according to a selection of a user in a case in which a discharge fault is detected, and a third operation mode (hereinafter, a forced printing mode) that executes the discharge operation without transitioning to the maintenance operation until a maintenance transition condition, which is established in advance, is satisfied. Hereinafter, selection and setting of an operation mode, and a printing operation based on a selected operation mode will be described.

FIGS. 4 to 6 are views that show GUI screens relating to the selection of an operation mode. The CPU 9 can display the printing setting screen, which is shown in FIG. 4, on the display device 18. On the printing setting screen, a thick-bordered frame (hereinafter, referred to as a selection frame) indicates a currently selected option. That is, in the example of FIG. 4, "operation mode settings" is selected. Additionally, the current selection or setting is not limited to a selection frame and can be indicated using reversed display or another display method. In addition, a small triangular indicator that is displayed adjacent to the selection frame indicates that more detailed setting is possible for the option indicated by the selection frame. In the example of FIG. 4, "Paper Settings" is an option for setting the type and size of the recording medium to be set as a printing target. In addition, "PG Settings" is an option for changing the distance between the nozzles 38 of the recording head 21 and the platen 30 depending on the type of the recording medium. Further, "Operation Mode Settings" is an option for setting the above-mentioned operation mode. It is possible for a user to perform respective setting by selecting one of the options as a result of moving the selection frame up and down by manipulating the button manipulation reception portion 8 on the printing setting screen. Alternatively, manipulation buttons that correspond to the options may be provided on the housing surface of the printer 2, and setting may be performed as a result of a user manipulating (pushing down) a desired manipulation button. Further, when "Operation Mode Settings" is selected, the CPU 9 displays an operation mode selection screen such as that shown in FIG. 5 for selecting the operation mode on the display device 18 (displaying an operation mode selection screen). Additionally, the display content of the printing setting screen is not limited to the content illustrated by way of example in FIG. 4, and may be any kind of content as long as at least options relating to setting of the operation mode are included.

FIG. 5 is a view that shows an example of an operation mode selection screen. In addition, FIG. 6 is a view that shows an individual operation mode selection screen for each type of ink. In the present embodiment, it is possible to set the operation mode for each type (color) of ink. Therefore, a total of four options that respectively correspond to cyan, magenta, yellow, and black are displayed on the operation mode selection screen. In addition, the respective currently set operation modes are displayed next to the name of the color of the ink. In the present embodiment, an operation mode that corresponds more suitably to the type of ink is displayed in the options as an initial setting (a default). For example, for black ink, which is used often in printing of characters, diagrams, and the like, since dot omission due to a discharge fault of a nozzle in a printed image is more likely to be recognized visually, the safe mode in which the execution frequency of the maintenance operation is the highest, but in which it is possible to suppress deteriorations in the quality of a printed image, which is a product of the printing operation, most, is set as an initial setting. In addition, since it is unlikely that a certain amount of dot omission in a printed image will stand out for color ink other than black, the semi safe mode or the safe mode are set as initial settings. For example, in particular, for yellow ink, since it is more unlikely that dot omission will stand out than for ink of other colors, it is possible to configure such that the forced printing mode is set as an initial setting. As a result of a more suitable operation mode being set as an initial setting for each type of ink in this manner, a circumstance in which a user is unsure of a selection is reduced. In addition, the initial setting of the operation mode is not limited to depending on the type of ink, and it is possible to set the initial setting of the operation mode to correspond to the type of the recording medium, which is the landing target of the ink. For example, in a case in which photographic paper for printing photographic images is selected, since it is possible to consider that the quality of the printed image will be emphasized, it is possible to set the safe mode as the initial setting. In addition, in a case in which a recording medium such as a fabric for which it is likely that ink will spread in a case of landing ink thereon, is selected, it is possible to configure such that the forced printing mode is set as the initial setting. In this configuration, a circumstance in which a user is unsure of a selection is also reduced.

It is possible to switch to an individual operation mode selection screen by selecting one of the options (colors) on the operation mode selection screen, and select and set one of the safe mode, the semi safe mode, and the forced printing mode for each color on the corresponding individual operation mode selection screen. In FIG. 6, an individual operation mode selection screen that corresponds to cyan ink is displayed as an example. The CPU 9 receives a selection of an operation mode by a user through the operation mode selection screen (the individual operation mode selection screens) (receiving a selection of an operation mode), sets the received operation mode (setting a received operation mode), and executes a printing operation, and the like, in the manner to be described below on the basis of the corresponding operation mode. In this manner, since it is possible to set an operation mode for each type of ink, it is possible to perform operations that a user desires depending on the type of ink, the printing content, the printing application, or the like.

In this instance, in the printer 2, in addition to each of the above-mentioned settings, it is possible to select at least a recording mode (a type of first discharge mode) that emphasizes printing speed (the speed of the discharge operation) and a recording mode (a type of second discharge mode) that emphasizes printing quality in the printing settings, and when the above-mentioned forced printing mode is selected in a case in which the latter second discharge mode is selected, it is desirable that the CPU 9 present a user with a warning (for example, a message such as "It is possible that there will be a deterioration in printing quality in the forced printing mode. Please check the operation mode.") that prompts checking of the operation mode using the display device 18 or a presentation unit (for example, another display device that is connected to the computer 1). As a result of this, a circumstance in which the printing quality is impaired in a case in which a user unintentionally selects the forced printing mode by mistake, can be prevented from occurring.

Next, each of the above-mentioned operation modes will be described in an individual manner.

Figure 7:
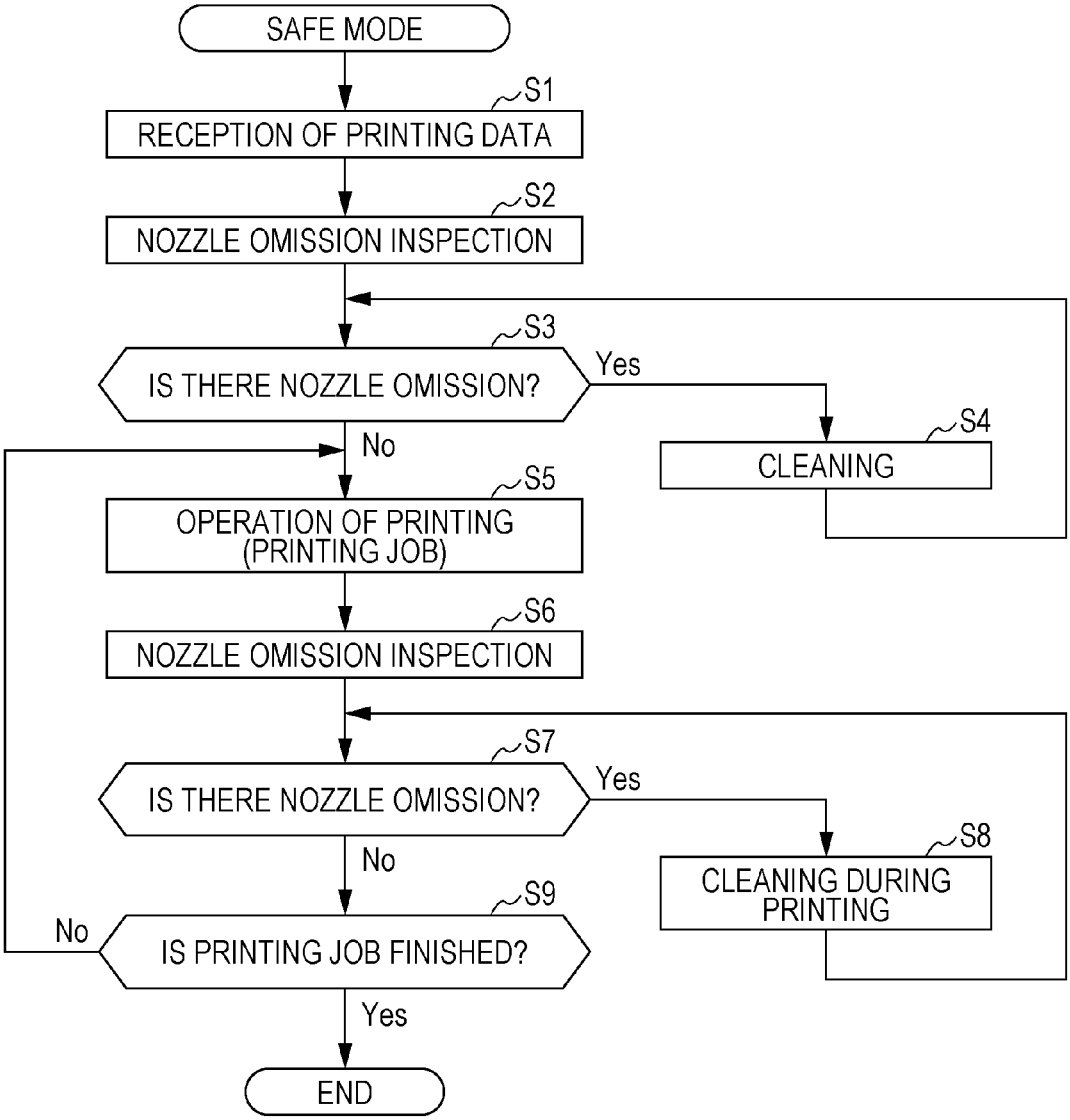
FIG. 7 is a flowchart that describes a flow of operations in a safe mode.

FIG. 7 is a flowchart that describes the operations of the printer 2 in a case in which the operation mode is set to the safe mode. When printing data such as an image and a printing instruction are received from the computer 1, or the like, (Step S1), firstly, the CPU 9 performs a nozzle omission inspection for each nozzle 38 of the recording head (Step S2). In the present embodiment, the CPU 9 executes a nozzle omission inspection using the nozzle omission detection mechanism 17 in conjunction with performing the flushing operation by discharging ink from each nozzle 38 toward the cap 26 or the ink reception portion 32 as a result of moving the recording head 21 above the capping mechanism 25 or the flushing box 31 by controlling the carriage movement mechanism 14. Electrode members, which are not illustrated in the drawings, are installed in inner portions of the cap 26 and the ink reception portion 32, and an electric field is applied between the corresponding electrode member and the nozzle plates 34 of the head units 20. Further, the nozzle omission detection mechanism 17 outputs a change in voltage from ink being discharged from a nozzle 38 up to landing inside the cap 26, to the CPU 9 as a detection signal. The CPU 9 determines whether or not there is a nozzle omission on the basis of the detection signal from the nozzle omission detection mechanism 17 (Step S3). That is, ink droplets are discharged from the nozzles 38 in a practical sense, and a nozzle 38 for which a change occurs in the detection signal in accordance with the discharge is determined to be a normal nozzle in which a discharge fault has not occurred. On the other hand, a nozzle 38 in which there is not a change in the detection signal regardless of the piezoelectric element 36 being driven and an ink discharge operation being performed is determined to be an "omitted nozzle" in which a "nozzle omission", which is a state in which a discharge fault has occurred, has occurred. Additionally, since this kind of detection method of a nozzle omission is well known, a more detailed description will be omitted. In addition, as a detection method of nozzle omission it is possible to adopt various well-known methods such as a method that performs determination on the basis of a counter electromotive force signal of a piezoelectric element 36 due to pressure vibrations (residual vibrations) that occur in the ink inside a pressure chamber 39 when the piezoelectric element 36 is driven, a method that prints a test pattern for nozzle omission detection on a recording medium such as a recording sheet and allows a user to perform determination on the basis of the corresponding test pattern, and a method due to optical detection of ink droplets discharged from a nozzle 38.

In the present embodiment, the presence or absence of a nozzle omission is determined for each color of ink, that is, for each head unit 20. In a case in which it is determined that there is a nozzle omission in Step S3 (Yes), the process transitions to the cleaning operation, which is the maintenance operation (Step S4). That is, the capping mechanism 25 restores the discharge performance of an omitted nozzle as a result of forcibly ejecting ink and air bubbles into the inside of the caps 26 from the nozzles 38 of the head units 20 for which there is a nozzle omission, by changing interior spaces of the caps 26 to have a negative pressure as a result of operating a pump in a state in which the nozzle surfaces of the head units 20 are capped using the caps 26. Alternatively, the discharge performance of omitted nozzles may be restored using a pressurization cleaning operation that increases the pressure of a flow channel on an upstream side more than the head units 20 by activating the flow channel pump 29. When the cleaning operation is complete, returning to Step S3, the operations from then on are repeated until it is determined that there is not a nozzle omission. In the present embodiment, since it is possible to perform the maintenance operation for each color of ink (for each head unit 20), a circumstance in which ink for which there is not a nozzle omission is unnecessarily consumed in the maintenance operation is prevented. In addition, since the amount of ink that is discharged in the maintenance operation is reduced, it is possible to prolong the life of the liquid ejection tank.

In Step S3, in a case in which it is determined that there is not a nozzle omission (No), the CPU 9 executes a printing operation (a series of printing jobs based on the printing data) according to the settings of the safe mode (Step S5). That is, the recording medium S is delivered onto the platen 30 by the transport mechanism 13, and an image, or the like, is printed on the recording medium S by discharging ink from the nozzles 38 on the basis of the printing data while the recording head 21, which is mounted in the carriage 23, is relatively moved with respect to the recording medium S by the carriage movement mechanism 14. Additionally, a printing operation that corresponds to a single item of image data is referred to as a series of printing jobs. Accordingly, in a case of printing a plurality of copies of the same item of image data, an operation until printing of all of the copies is complete is a series of jobs. In the printing operation, the flushing operation is performed above the flushing box 31 at regular intervals such as every predetermined number of passes. At this time, nozzle omission inspection is performed in the above-mentioned manner (Step S6), and the CPU 9 determines whether or not there is a nozzle omission on the basis of the detection signal from the nozzle omission detection mechanism 17 (Step S7). In a case in which it is determined that there is a nozzle omission in Step S7 (Yes), the process transitions to a cleaning operation that can be executed during the printing operation (the mid-printing cleaning operation) (Step S8). That is, the maintenance mechanism 15 restores the discharge performance of the nozzles 38 by increasing the pressure inside the liquid flow channel further on the upstream side than the recording head (the head units 20) using the flow channel pump 29 in the above-mentioned manner. When the mid-printing cleaning operation is complete, returning to Step S7, the operations from then on are repeated until it is determined that there is not a nozzle omission.

Further, in Step S7, in a case in which it is determined that there is not a nozzle omission (No), the CPU 9 determines whether or not the series of printing jobs is finished (Step S9). That is, it is determined whether or not the entire printing operation for the image data received in Step S1 is finished, and in a case of printing a plurality of copies on the basis of the same image data, it is determined whether or not the printing operations of the corresponding copies of have been completed. In Step S9, in a case in which it is determined that the printing job is not finished (No), the process returns to Step S5, and the processes from then on are repeated. On the other hand, in Step S9, in a case in which it is determined that the printing job is finished (Yes), the process is finished (the process transitions to the corresponding job if there is a subsequent job, and stands by for an execution instruction of a subsequent job if there is not a subsequent job. Same applies below). In this manner, in the safe mode, since the maintenance operation is performed automatically each time a nozzle omission is detected, a deterioration in image quality (that is, a deterioration in the quality of a product of the discharge operation) due to a nozzle omission is more reliably prevented.

In this instance, in the safe mode in the present embodiment, in a case in which the ink consumption amount exceeds a threshold value, which is established in advance, that is, a case in which the residual amount of ink inside an ink cartridge 22 is running low, the CPU 9 notifies a user of the fact that the residual amount of ink inside the ink cartridge 22 is running low using the display device 18. As a result of this, a defect in which a printing operation is performed regardless of the fact that the residual amount of ink inside an ink cartridge 22 is depleted, and there is a deterioration in the quality of a printed image due to the occurrence of a nozzle omission, can be prevented from occurring.

Additionally, in the safe mode in the present embodiment, a configuration in which the mid-printing maintenance operation (the mid-printing cleaning operation) is performed by the maintenance mechanism 15 (the flow channel pump 29) without interrupting the printing operation in a case in which a nozzle omission is detected during a printing operation, is illustrated by way of example, but the invention is not limited to this configuration, and it is also possible to apply the invention to a configuration that is not provided with a unit that performs a maintenance operation during printing. In this configuration, for example, in a case in which a nozzle omission is detected during a printing operation, the process transitions to the maintenance operation (the cleaning operation) by the capping mechanism 25, and the like, of the maintenance mechanism 15 by temporarily interrupting printing, and as long as the nozzle omission is resolved by the corresponding maintenance operation, it is possible to eject the recording medium S on which printing is underway from the platen 30, transport a new recording medium S onto the platen 30 and execute a printing operation for the same image data anew on the corresponding new recording medium S.

Figure 8:
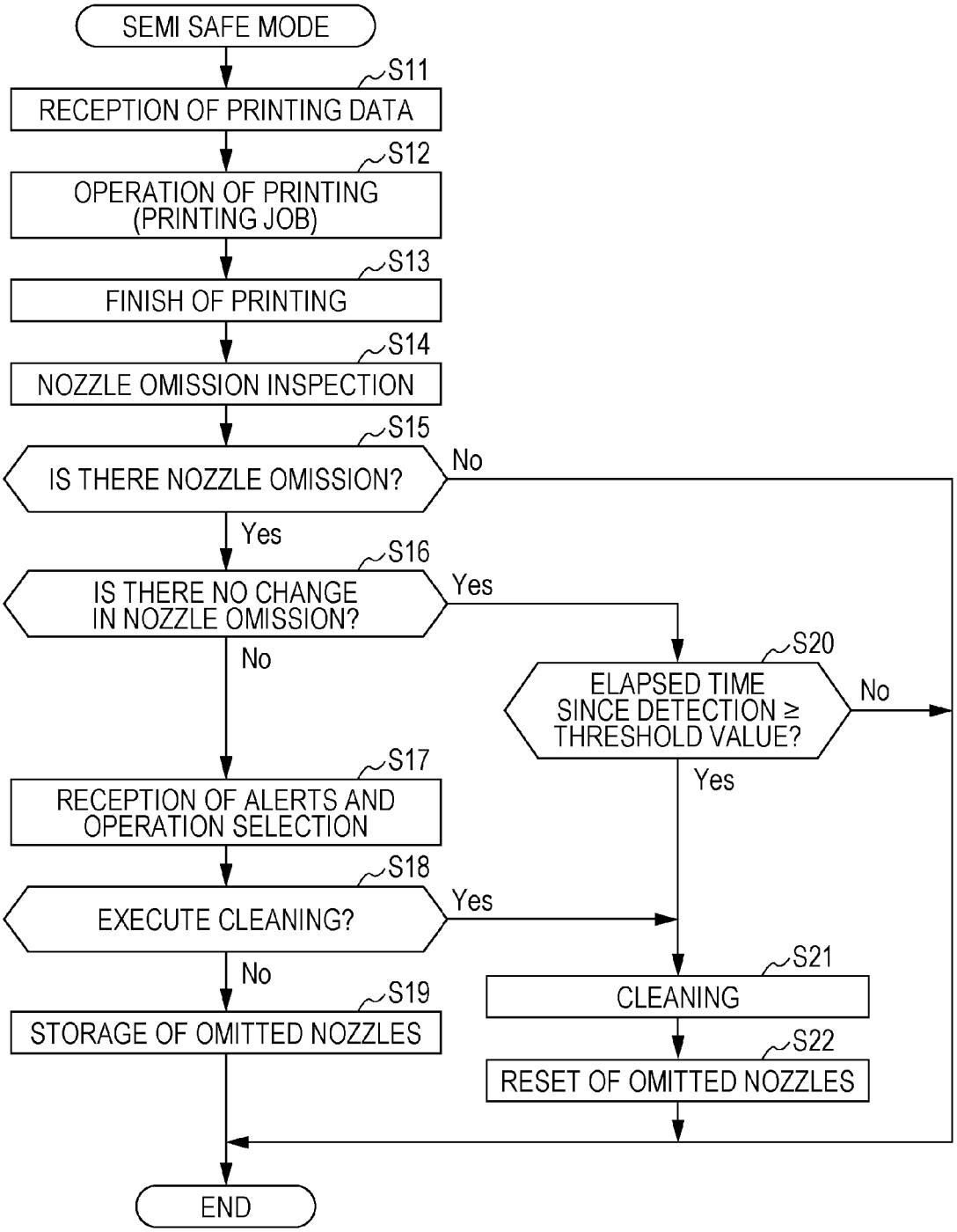
FIG. 8 is a flowchart that describes a flow of operations in a semi safe mode.

FIG. 8 is a flowchart that describes the operations of the printer 2 in a case in which the operation mode is set to the semi safe mode. When printing data such as an image and a printing instruction are received from the computer 1, or the like (Step S11), the CPU 9 initiates a printing operation (a printing job) according to the semi safe mode (Step S12). In the semi safe mode in the present embodiment, nozzle omission detection by the nozzle omission detection mechanism 17 is not performed until a series of printing jobs is complete. However, in a case in which the residual amount of ink inside an ink cartridge 22 is running low during a printing operation, in the above-mentioned manner, the CPU 9 notifies a user of the fact that the residual amount of ink inside the ink cartridge 22 is running low using the display device 18. As a result of this, a defect in which a printing operation is performed regardless of the fact that the residual amount of ink inside an ink cartridge 22 is depleted, and there is a deterioration in the quality of a printed image due to the occurrence of a nozzle omission, can be prevented from occurring.

When the printing operation (a series of printing jobs) is finished (Step S13), an inspection of nozzle omission is subsequently executed by the nozzle omission detection mechanism 17 (Step S14). The CPU 9 determines whether or not there is a nozzle omission on the basis of the detection signal from the nozzle omission detection mechanism 17 (Step S15). The process is finished in a case in which it is determined that there is not a nozzle omission in Step S15 (No). On the other hand, in a case in which it is determined that there is a nozzle omission in Step S15 (Yes), the CPU 9 determines whether or not a nozzle 38 in which the current nozzle omission was determined is a change from the nozzles 38 in which a previous nozzle omission was determined in a prior inspection (whether or not the nozzle 38 is a nozzle 38 that is already stored in a nozzle omission table) by referring to a nozzle omission table that is stored in a predetermined recording region of the storage device 10 (Step S16). The nozzle omission table is a table in which nozzles 38 in which a nozzle omission has been determined (omitted nozzles), are stored. For example, in the nozzle omission table, a nozzle omission is stored in association with a time (the time and date) at which the nozzle omission was detected, the nozzle row (the color of ink) to which the corresponding nozzle 38 belongs, the position in the corresponding nozzle row, and the like. Additionally, the nozzle omission table of the present embodiment is used in the semi safe mode and the forced printing mode. Further, in Step S16, in a case in which it is determined that there is a change in the omitted nozzles (there is a nozzle 38 that is not stored in the nozzle omission table in which a nozzle omission is newly determined) (No), the CPU 9 displays (presents) a warning (an alert) and an operation selection screen for prompting a user to select an operation of the printer 2 on the display device 18, and transitions to an operation option reception mode that receives one of the options from a user via the corresponding operation selection screen (Step S17).

FIG. 9 is a view that shows an example of the above-mentioned operation selection screen. The fact that a nozzle omission has been detected, and for example, a warning such as "Nozzle Omission Detected" is displayed on the operation selection screen. In addition, for example, a display prompting checking of a printing result (a product) such as an image printed on a recording medium in a state in which a nozzle omission has occurred and selection of a single operation from among a plurality of operations, such as "Please Select a Process After Checking Printing Result." is displayed. More specifically, a first option that indicates executing a cleaning operation, and a second option that indicates continuing the printing operation, are displayed, and it is possible for a user to select either option by manipulating the button manipulation reception portion 8. Additionally, for example, it is possible to add other options such as a third option that indicates changing the operation mode for the ink that corresponds to the nozzle omission. As a result of providing an option according to which it is possible to change the operation mode, it is also possible to handle a case in which a user wishes to change the operation mode due to a change in status, or the like. Furthermore, information relating to nozzle omission is displayed on the alert and operation selection screen in conjunction as determination material of operation selection. In the present embodiment, for example, the number of nozzles in which a nozzle omission is determined is displayed for nozzles 38 that correspond to the color of ink for which the semi safe mode is set in the manner of "Black Nozzles: 3 Locations". In addition, in a case in which a nozzle omission occurs in an adjust nozzle 38, words to that effect are displayed. A user selects one of the above-mentioned processes on the basis of the printing result and nozzle omission information on the operation selection screen.

Subsequently, the CPU 9 determines whether or not the execution of the cleaning operation was selected as a result of a user selecting the first option (Step S18). In a case in which it is determined that the execution of the cleaning operation has not been selected (No), that is, in a case in which it is determined that the continuance of a printing operation is selected as a result of selecting the second option, the CPU 9 stores the nozzle 38 in which the current nozzle omission was determined in the nozzle omission table of the storage device 10 (Step S19), and the process is finished. On the other hand, in a case in which it is determined that the execution of the cleaning operation was selected in Step S18 (Yes), that is, in a case in which the user selected the first option, the process transitions to the cleaning operation using the maintenance mechanism 15 (the capping mechanism 25), and the cleaning operation is performed until it is determined that there is not a nozzle omission (Step S21). When the mid-printing cleaning operation is completed, the CPU 9 resets the nozzle omission table of the storage device 10 (Step S22). That is, the information of the nozzles 38 that is stored in the nozzle omission table is deleted. After the nozzle omission table is reset, the process is finished.

In the above-mentioned Step S16, in a case in which it is determined that there is not a change in the omitted nozzles (the nozzle 38 in which the current nozzle omission is determined is a nozzle that is stored in the nozzle omission table) (No), the CPU 9 subsequently determines whether or not the elapsed time since the corresponding nozzle omission was detected has reached a threshold value, which is established in advance, by referring to a detection time of nozzle omission that is stored in the nozzle omission table (Step S20). That is, after a previous nozzle omission is detected, in a case in which the continuance of a printing operation is selected without performing the cleaning operation, since there is a risk that, due to the thickening of ink, it will no longer be possible to recover the discharge performance even if the maintenance operation is used if the printing operation is continued in a state in which a nozzle omission has occurred, the threshold value for the elapsed time since the nozzle omission was detected is establish in advance. In addition, a weighting is given to the corresponding elapsed time depending on the type of ink and a use environment (the temperature or humidity). For example, as a result of multiplying a weighted coefficient by the elapsed time, the elapsed time is made sooner than for other types of ink for types of ink that are relatively likely to thicken. A coefficient is also multiplied in the same manner for a case in which the temperature detected by a temperature sensor, or the like, is higher than a predetermined value, in a case in which the humidity detected by a humidity sensor is lower than a predetermined value, or the like. It is possible to configure such that this kind of weighted coefficient is stored in association with an omitted nozzle in the nozzle omission table.

In Step S20, the CPU 9 determines whether or not the elapsed time is a threshold value or more for the nozzle for which the detection time is the earliest among omitted nozzles that are stored in the nozzle omission table, and the process is finished in a case in which it is determined that the corresponding elapsed time has not yet reached the threshold value (No). On the other hand, in Step S20, in a case in which it is determined that the above-mentioned elapsed time is the threshold value or more (elapsed time threshold value) (Yes), the process the process transitions to the cleaning operation of the maintenance mechanism 15 (the capping mechanism 25), and the cleaning operation is performed until there are no nozzle omissions (Step S21). When the cleaning operation is completed, the process is finished after the CPU 9 resets the nozzle omission table of the storage device 10 (Step S22). In this manner, as a result of applying a weighting to the elapsed time of a nozzle omission, it is possible to execute the cleaning operation at a more suitable timing. As a result of this, it is possible to suppress waste of ink and operation time while further reducing the risk that discharge performance will become irreparable. Additionally, the CPU 9 performs display of the fact that a nozzle omission has occurred for printed matter (a recording medium S) that is printed in a state in which a nozzle omission has been generated. For example, a message or a symbol that indicates the fact that "Nozzle Omission Present", or the like, is printed in a location that does not stand out such as the blank space of the printed matter. Alternatively, the corresponding message, or the like, is displayed on the above-mentioned display device 18, a log file to that effect is created via the printer driver 7 of the computer 1, or the like, and the corresponding log is displayed on a display device, or the like, that is connected to the computer 1. As a result of this kind of display, the determination of whether or not the corresponding printed matter is faulty is facilitated.

In this manner, in a case in which a nozzle omission is detected in the semi safe mode, since a user is allowed to choose whether or not to transition to the cleaning operation, which is a maintenance operation, or whether or not to continue a printing operation, it is possible to handle the requests of a user more flexibly. In addition, in a case in which a nozzle omission is detected, as a result of presenting a user with information relating to a discharge fault of the nozzle 38 using the display device 18 or another presentation unit, determination of operation selection by a user is facilitated. Furthermore, in a case in which a discharge fault is detected, since the above-mentioned operation option reception mode is skipped when a nozzle 38 in which a nozzle omission is detected is the same as a nozzle that is stored in the nozzle omission table (there is not a change in omitted nozzles), it is possible to reduce the inconvenience of a user performing selection of an operation as a result of the printing operation being interrupted for the operation option reception mode, and in addition, it is possible to suppress a determination in throughput. In this case, since the process transitions to the maintenance operation when the elapsed time since a discharge fault was detected exceeds a threshold value, which is established in advance, for a nozzle in which a discharge fault has previously been detected, it is possible to execute a cleaning operation at a suitable timing. As a result of this, it is possible to suppress waste of ink and operation time while reducing the risk that discharge performance will become irreparable.

Figure 10:
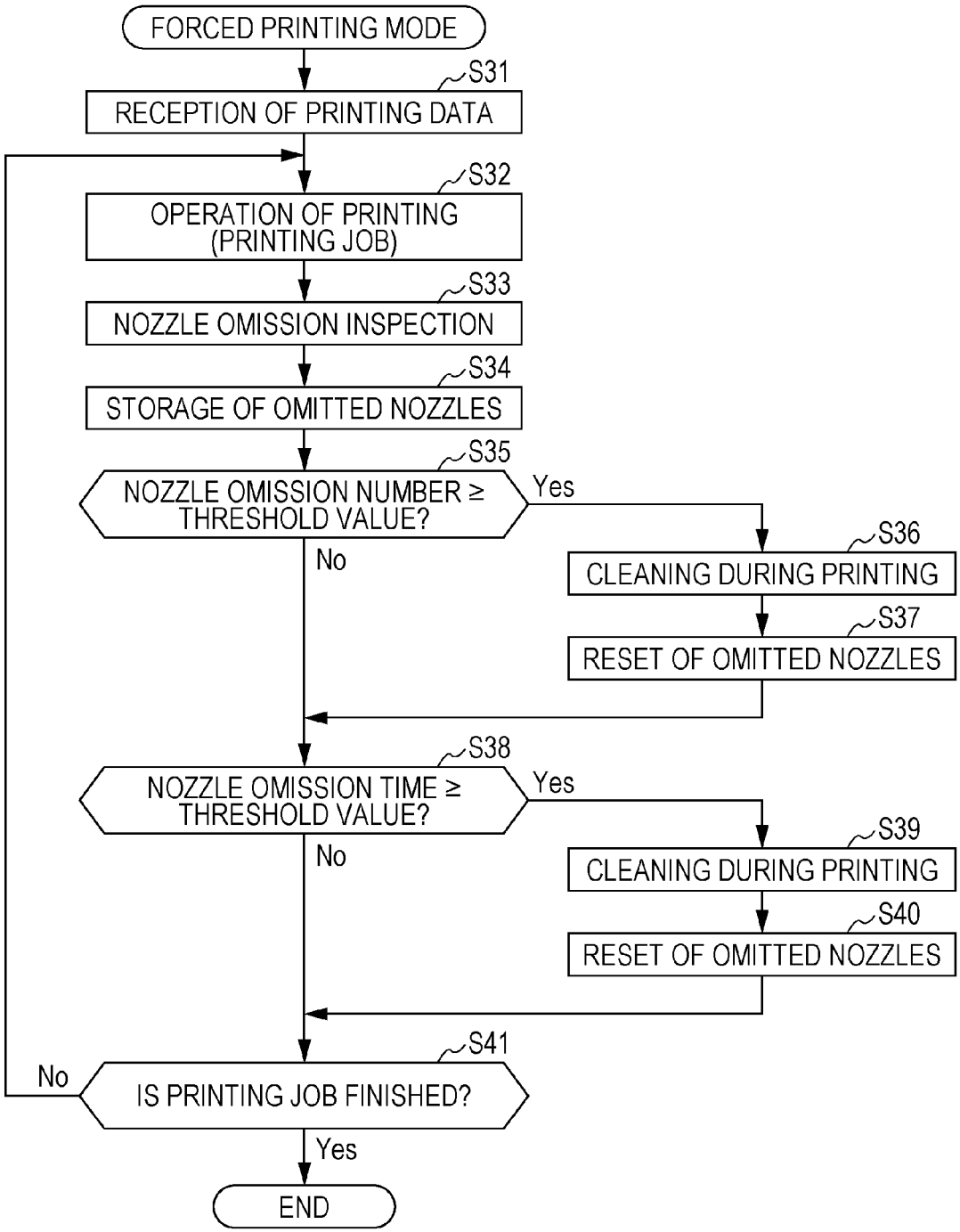
FIG. 10 is a flowchart that describes a flow of operations in a forced printing mode.

FIG. 10 is a flowchart that describes the operations of the printer 2 in a case in which the operation mode is set to the forced printing mode. When printing data such as an image and a printing instruction are received from the computer 1, or the like (Step S31), the CPU 9 initiates a printing operation (a series of printing jobs) according to the forced printing mode (Step S32). During a flushing operation, which is performed at regular intervals in a printing operation, a nozzle omission inspection is performed for a nozzle 38 that corresponds to an ink that is set to the forced printing mode in the above-mentioned manner (Step S33). The CPU 9 stores a nozzle 38 in which a nozzle omission is newly detected in the nozzle omission inspection, in the nozzle omission table (Step S34). Next, the CPU 9 determines whether or not a number of nozzles in which a nozzle omission is determined in the nozzle omission inspection is a threshold value, which is established in advance, or more (Step S35). In this instance, the number of nozzles in which a nozzle omission is determined is a type of the degree of occurrence of a discharge fault of the invention, and the corresponding number of nozzles reaching the threshold value is a maintenance transition condition of the invention. Even in cases in which nozzle omission occurs at the same frequency, in a case of respectively being generated scattered in a separate manner (a case in which there is not another nozzle omission next to the nozzle omission), and a case of respectively occurring in adjacent nozzles, there is a tendency for the latter case to stand out more in a printed image, or the like (the influence on the printing quality due to nozzle omission is larger). Therefore, in the present embodiment, in a calculation of the number of nozzles in which a nozzle omission is determined, a weighting is respectively applied in a case in which a nozzle omission is determined, for adjacent nozzles 38 in the same nozzle row. For example, the same weighting is multiplied by the number of mutually adjacent omitted nozzles. That is, a case in which two omitted nozzles are adjacent is counted as 4 as a result of 2, which is the practical number, being further multiplied by 2 as a weighting. In the same manner, a case in which three omitted nozzles are adjacent is set as 9 as a result of 3, which is the practical number, being further multiplied by 3 as a weighting.

In addition, in a configuration in which a plurality of nozzle rows to which ink of the same color is allocated, are line up in the manner of the recording head 21 of the present embodiment, since there are cases in which dot omission in a printed image due to nozzle omission is supplemented by the same row, that is, for example, cases in which a process such as discharging ink from a nozzle 38 having the same number as an omitted nozzle in an adjust nozzle row or a nozzle 38 in the vicinity of the omitted nozzle in place of discharging ink from the omitted nozzle, is performed, the number of omitted nozzles is counted taking this feature into consideration. For example, a nozzle row A and a nozzle row B to which ink of the same color is allocated are respectively divided into groups (set as domains) using sets of a plurality of mutually adjacent nozzles 38. If the respective number of nozzles 38 that belong to each nozzle row is 360, and the numbers 1 to 360 are respectively allocated, for the nozzle row A, a set of the nozzles 38 from number 1 to number 10 is set as a domain A1, a set of the nozzles 38 from number 11 to number 20 is set as a domain A2, domains are set in this manner from A1 to A36. In the same manner, domains are set from B1 to B36 for the nozzle row B. Further, a number of omitted nozzle is counted by multiplying the domains of the same number of both nozzle rows. More specifically, for example, in a case in which nozzle number 5 of A1 is an omitted nozzle (a virtual count is set to 1), the count is set to 0 by multiplying 1 by 0 when nozzle number 5 of B1 is not an omitted nozzle (a virtual count is set to 0). In addition, the count is set to 1 by multiplying 1 by 1 in a case in which nozzle number 5 of A1 and nozzle number 5 of B1 are both omitted nozzles. Furthermore, a weighting is multiplied in the above-mentioned manner when as a result of multiplication, there is nozzle omission in nozzles of adjacent numbers.

In Step S35, in a case in which it is determined that the number of nozzles in which a nozzle omission is determined is a threshold value, which is established in advance, or more (Yes), the process the process transitions to the cleaning operation of the maintenance mechanism 15 (the flow channel pump 29), and the cleaning operation is performed until there are no nozzle omissions (Step S36). When the cleaning operation is completed, the process transitions to the process of Step S38 after the CPU 9 resets the nozzle omission table of the storage device 10 (Step S37). On the other hand, in Step S35, in a case in which it is determined that the number of nozzles in which a nozzle omission is determined does not satisfy the threshold value, which is established in advance (No), the mid-printing cleaning operation is not performed (is skipped), and the CPU 9 subsequently determines whether or not the elapsed time since the corresponding nozzle omission was detected is a threshold value, which is established in advance, or more for the nozzle for which the detection time is the earliest among omitted nozzles that are stored in the nozzle omission table (Step S38). In this instance, the elapsed time since the nozzle omission was detected is a type of the degree of occurrence of a discharge fault of the invention, and the corresponding elapsed time reaching the threshold value is a maintenance transition condition of the invention. In the above-mentioned manner, a weighting is given to the corresponding elapsed time depending on the type of ink and a use environment (the temperature or humidity). In a case in which it is determined that the above-mentioned elapsed time is the threshold value or more in Step S38 (Yes), the process the process transitions to the mid-printing cleaning operation of the maintenance mechanism 15 (the flow channel pump 29), and the cleaning operation is performed until there are no nozzle omissions (Step S39). When the mid-printing cleaning operation is completed, the process transitions to the process of Step S41 after the CPU 9 resets the nozzle omission table of the storage device 10 (Step S40). On the other hand, in Step S38, in a case in which it is determined that the elapsed time has not yet reached the threshold value (No), the mid-printing cleaning operation is not performed (is skipped), and the CPU 9 determines whether or not the series of printing jobs is finished (Step S41). In Step S41, in a case in which it is determined that the printing job is not finished (No), the process returns to Step S32, and the processes from then on are repeated. On the other hand, in Step S41, the process is finished in a case in which it is determined that the printing job is finished (Yes).

In this manner, in the forced printing mode, since the discharge operation (a printing operation) is performed without transitioning to the maintenance operation (the cleaning operation) until a maintenance transition condition, which is established in advance, is satisfied, a deterioration in throughput of an amount corresponding to the maintenance operation not being performed frequently is suppressed, a circumstance in which ink is unnecessarily consumed in the maintenance operation is suppressed, and in addition, the inconvenience for a user of performing confirmation and selection relating to transitioning to the maintenance operation is also reduced. In particular, it is possible to perform a discharge operation and a maintenance operation that are more optimized for types of liquid landing targets, and the like, in which it is unlikely that a problem will occur in the quality of a product (an image, or the like) due to a discharge operation even if the discharge operation is performed in a state in which the discharge fault occurs. In addition, since the process also transitions to the maintenance operation in the forced printing mode when the maintenance transition condition is realized (when the degree of occurrence of a discharge fault reaches a threshold value, which is established in advance), it is possible to reduce the risk that the printing quality will be significantly decreased, that the discharge performance will become irreparable, or the like.

In this instance, in the forced printing mode in the present embodiment, in a case in which the residual amount of ink inside an ink cartridge 22 is running low during a printing operation, the CPU 9 does not notify a user of the fact that the residual amount of ink inside the ink cartridge 22 is running low. As a result of this, since a printing operation is not interrupted, it is possible to suppress a deterioration in throughput. In addition, since a user is not prompted to replace an ink cartridge 22 during a printing operation, it is possible to reduce an inconvenience. Additionally, in a case in which the residual amount of ink inside an ink cartridge 22 is running low during a printing operation, the CPU 9 performs a notification after a series of printing jobs is finished. As a result of this, a defect in which there is a deterioration in the quality of a printed image due to the occurrence of a nozzle omission in a subsequent printing operation, is prevented.

Additionally, in the forced printing mode in the present embodiment, a configuration in which the mid-printing maintenance operation (the mid-printing cleaning operation) is performed by the maintenance mechanism 15 (the flow channel pump 29) without interrupting the printing operation in a case in which the maintenance transition condition is realized, is illustrated by way of example, but the invention is not limited to this configuration, and it is also possible to apply the invention to a configuration that is not provided with a unit that performs a maintenance operation during printing. In this configuration, for example, in a case in which the maintenance transition condition is realized during a printing operation, the process transitions to the maintenance operation (the cleaning operation) by the capping mechanism 25, and the like, of the maintenance mechanism 15 by temporarily interrupting printing, and as long as the nozzle omission is resolved by the corresponding maintenance operation, it is possible to eject the recording medium S on which printing is underway from the platen 30, transport a new recording medium S onto the platen 30 and execute a printing operation for the same image data anew on the corresponding new recording medium S.

In the above-mentioned manner, in the printer 2 according to the invention, since an operation mode selection screen for selecting a plurality of operation modes in which a situation in which a transition to the maintenance operation (the cleaning operation) is performed in a case in which a discharge fault (a nozzle omission) is detected, differs, is displayed on the display device 18, and a printing operation (the discharge operation) of the recording head 21 is executed on the basis of the operation mode selected by a user using the operation mode selection screen, it is possible to perform a discharge operation and a maintenance operation that are more suited to the type of liquid to be discharged, the type of the landing target of the corresponding liquid, the content of a product (a printed image, or the like) of a discharge operation, or the needs of a user.

Additionally, it is also possible for the operations that the CPU 9 performs in the above-mentioned embodiment to be performed by a printer driver 7 that can be executed in the computer 1, which is connected to the printer 2. In this case, it is possible to display an operation mode selection screen, or the like, on a display device such as a liquid crystal display device that is connected to the computer 1 in place of the display device (displaying an operation mode selection screen), receive a selection of an operation mode by a user through the corresponding operation mode selection screen (receiving a selection of an operation mode), and indirectly set a received operation mode in the printer 2 by transmitting information relating to the received operation mode to the printer 2 (setting a received operation mode).

Furthermore, in each of the above-mentioned embodiments, a configuration in which the four colors of ink of black ink, cyan ink, magenta ink and yellow ink are discharged from the recording head 21 is illustrated by way of example, but the invention is not limited to this configuration, and it is also possible to apply the invention to a configuration that, in addition to the above-mentioned four colors, discharges inks other than the basic colors such as light cyan ink, light magenta ink, white ink or silver ink.

Further, as long as the invention is applied to a liquid discharging apparatus, the invention is not limited to the above-mentioned printer 2, and can also possible be applied to various ink jet type recording apparatuses such as a facsimile apparatus or a copy machine, or a liquid droplet discharging apparatus such as a textile printing apparatus that performs textile printing by landing an ink from a liquid discharging head on a fabric (a target textile printing material), which is a type of landing target. In addition, the invention can also be applied to a device driver relating to such an apparatus.

The entire disclosure of Japanese Patent Application No. 2016-047889, filed Mar. 11, 2016 is expressly incorporated by reference herein.

What is claimed is:

1. A liquid discharging apparatus comprising:

a liquid discharging head that discharges a liquid from a nozzle;

a control circuit that controls a discharge operation of the liquid discharging head;

a nozzle omission detection mechanism that detects a discharge fault of the nozzle;

a maintenance mechanism that performs a maintenance operation, which ejects the liquid from the nozzle of the liquid discharging head; and a display device that displays a setting screen relating to the discharge operation of the liquid discharging head, wherein the control circuit displays an operation mode selection screen for selecting a plurality of operation modes in which a situation in which a transition to the maintenance operation is performed in a case in which the discharge fault is detected, differs, on the display device, and executes the discharge operation of the liquid discharging head on the basis of the operation mode selected by a user using the operation mode selection screen, wherein the plurality of modes are a first operation mode that transitions to the maintenance operation automatically in a case in which the discharge fault is detected, a second operation mode that executes either the discharge operation or the maintenance operation according to a selection of a user in a case in which the discharge fault is detected, and a third operation mode that executes the discharge operation without transitioning to the maintenance operation until a maintenance transition condition, which is established in advance, is satisfied.

2. The liquid discharging apparatus according to claim 1, wherein, in a case in which the discharge fault is detected in the second operation mode, the control circuit displays an operation selection screen in which at least two of a first option that indicates continuing the discharge operation, a second option that indicates transitioning to the maintenance operation, and a third option that indicates changing the operation mode, are set as options, on the display device, transitions to an operation option reception mode that receives one of the options from a user via the corresponding operation selection screen, and executes a subsequent operation on the basis of a received option.

3. The liquid discharging apparatus according to claim 2, wherein, in a case in which the discharge fault is detected in the second operation mode, the control circuit presents a user with information relating to the discharge fault of the nozzle using the display device or another presentation unit.

4. The liquid discharging apparatus according to claim 2, wherein, in a case in which the discharge fault is detected in the second operation mode, the control circuit does not transition to the operation option reception mode when a nozzle in which the current discharge fault is detected is the same as a nozzle in which the discharge fault was previously detected.

5. The liquid discharging apparatus according to claim 4, wherein, in a case of not transitioning to the operation option reception mode, the control circuit transitions to the maintenance operation when an elapsed time since the discharge fault was detected exceeds a threshold value, which is established in advance, for the nozzle in which the discharge fault was previously detected.

6. The liquid discharging apparatus according to claim 1, wherein the maintenance transition condition in the third operation mode is a degree of occurrence of the discharge fault of a nozzle reaching a threshold value, which is established in advance.

7. The liquid discharging apparatus according to claim 1, wherein it is possible to select any one of a first discharge mode in which at least speed of the corresponding discharge operation is emphasized, and a second discharge mode in which quality of a product of the discharge operation on a landing target of the liquid is emphasized, as the discharge operation, and wherein, in a case in which the second discharge mode is selected, the control circuit presents a user with a warning that prompts confirmation of the operation mode, using the display device or another presentation unit when the third operation mode is selected.

8. The liquid discharging apparatus according to claim 1, wherein the liquid discharging head is capable of discharging different types of liquid, and wherein the operation mode for each type of liquid is capable of being set on the operation mode selection screen.

9. The liquid discharging apparatus according to claim 1, wherein the control circuit indicates an operation mode that corresponds to a type of a landing target of the liquid on the operation mode selection screen, as an initial setting.

10. A control method of a liquid discharging apparatus provided with a liquid discharging head that discharges a liquid from a nozzle, a control circuit that controls a discharge operation of the liquid discharging head, a nozzle omission detection mechanism that detects a discharge fault of the nozzle, and a maintenance mechanism that performs a maintenance operation, which ejects the liquid from the nozzle of the liquid discharging head, the method comprising:

displaying an operation mode selection screen for selecting a plurality of operation modes in which a situation in which a transition to the maintenance operation is performed in a case in which the discharge fault is detected, differs, on a display device;

receiving a selection of an operation mode by a user using the operation mode selection screen; and setting a received operation mode, wherein the plurality of modes are a first operation mode that transitions to the maintenance operation automatically in a case in which the discharge fault is detected, a second operation mode that executes either the discharge operation or the maintenance operation according to a selection of a user in a case in which the discharge fault is detected, and a third operation mode that executes the discharge operation without transitioning to the maintenance operation until a maintenance transition condition, which is established in advance, is satisfied.

11. A device driver that can be executed in an information processing apparatus connected to a liquid discharging apparatus in a manner in which communication can be performed, wherein the device driver executes the control method of a liquid discharging apparatus according to claim 10.

* * * * *